US007029350B2

(12) United States Patent
Katzfey

(10) Patent No.: US 7,029,350 B2
(45) Date of Patent: Apr. 18, 2006

(54) SECTIONALIZED SURFBOARD

(76) Inventor: Lance J. Katzfey, 9024 Meadowrun Pl., San Diego, CA (US) 92129

( * ) Notice: Subject to any disclaimer, the term of this patent is extended or adjusted under 35 U.S.C. 154(b) by 0 days.

(21) Appl. No.: 10/994,721

(22) Filed: Nov. 22, 2004

(65) Prior Publication Data

US 2005/0148248 A1 Jul. 7, 2005

Related U.S. Application Data

(60) Provisional application No. 60/534,518, filed on Jan. 5, 2004.

(51) Int. Cl.
*B63B 35/79* (2006.01)

(52) U.S. Cl. ..... 441/74; 114/77 R; 114/352

(58) Field of Classification Search ..... 441/74; 114/77 R, 352
See application file for complete search history.

(56) References Cited

U.S. PATENT DOCUMENTS

| | | | | |
|---|---|---|---|---|
| 2,584,685 | A * | 2/1952 | Evert | 114/352 |
| 2,847,961 | A * | 8/1958 | Meckenstock | 114/26 |
| 3,137,873 | A | 6/1964 | Garrolini | |
| 3,287,754 | A | 11/1966 | Price et al. | |
| 3,409,920 | A | 11/1968 | Brownley | |
| 4,807,549 | A | 2/1989 | Rhodes et al. | |
| 5,476,403 | A | 12/1995 | Hsia | |
| 5,711,692 | A | 1/1998 | Pope | |

* cited by examiner

*Primary Examiner*—Sherman Basinger

(57) ABSTRACT

A sectionalized surfboard, which can be dismantled into sections and rejoined for use. The sections are joined using a vertically installed bolt or pin. The bolt or pin is inserted through holes in metal plates mounted securely to the stringer on one section and a tube mounted securely to the stringer of the other section.

2 Claims, 5 Drawing Sheets

SECTIONALIZED SURFBOARD

CROSS-REFERENCE TO RELATED APPLICATIONS

This application claims the benefit of PPA APPL NO. 60/534,518, filed Jan. 5, 2004 by the present inventor.

FEDERALLY SPONSORED REASEARCH

Not Applicable

SEQUENCE LISTING OR PROGRAM

Not Applicable

BACKGROUND OF THE INVENTION

1. Field of Invention

This invention relates to a method for building a sectionalized, dissassemblable surfboard or sailboard type hull using a single vertically inserted bolt or pin to assemble the sections.

2. Background of the Invention

With the popularity of surfboards and sailboards there is a need to improve the transportability of the boards. Surfboards and sailboards do not fit into most vehicles, so a roof rack is required for transporting. In addition to the difficulty of adequately tying down the board, it is easy for someone to steal the board off the roof rack. In addition, sunlight will fade the colors and ages the plastic of the board. A sectionalized board, that can be disassembled, will solve these problems. By dividing the board in two or more pieces, the board can be stored inside the vehicle and be locked inside. This saves the time required to tie the board to the roof rack as well as the expense of the rack. The board sections can be stored in the trunk of a car. For storage at home, the disassembled board can easily be stored in a closet and can be maneuvered easily through hallways. To make the assembly acceptable to the user, the assembly and disassembly should only take a few seconds. The assembled board should be as strong as a normal one-piece board with only a small additional weight.

The only successfully marketed sectionalized surfboard design is the design described in U.S. Pat. No. 5,711,692 (1998) to Pope. This design uses clamps and a horizontal tube. The tube fits into receivers in the board sections. One disadvantage is that the tube can bend during use. Another disadvantage is the tube receivers are difficult to make and install into the board. This adds to the cost of making the board. If dirt or sand get into the tube receivers the board can be difficult to assemble or disassemble.

U.S. Pat. No. 5,476,403 (1995) to Hsia describes a sectionalized surfboard, which uses a horizontal pin or bolt to join the sections. This design uses a very long bolt and anchor structures with loops. Since under load, the loops and pin are in tension, the deck of the board must be strong enough to handle the compression loads. The main body of a surfboard is typically made of light foam and significant extra structure must be added to support the loops. U.S. Pat. No. 4,807,549 (1989) to Rhodes et al. describes a sectionalized board design using suitable chevon surfaces and a cable clamp. This board would be very difficult to build with a tight fit and also strong enough. The cable clamping would be difficult to get tight enough to prevent bending.

The sectionalized hull described in U.S. Pat. No. 3,137,873 (1964) to Garrolini discloses a system using telescoping shafts and suitable latches. The sleeves for the shafts would be difficult to mount securely in the surfboard and would add significant weight. In the sectionalized hull disclosed in U.S. Pat. No. 3,287,754 (1966) to Price et al., the hull sections are joined by pairs of clamp assemblies mounted on the upper and lower sides of their respective sections. These clamps would be difficult to install and would be very heavy. Another approach is disclosed in U.S. Pat. No. 3,409,920 (1968) to Brownley who uses a mortise-and-tenon socket and clip arrangement for joining the sections. This design would be difficult to make strong enough.

All these designs are expensive and complicated. They are susceptible to flexing if the parts are not made strong enough or wear with use. They are heavy and difficult to install in a standard surfboard.

OBJECTS AND ADVANTAGES

The object of the present invention is to provide a simplified sectional surfboard-like hull design, which can be adapted to use as a surfboard, windsurfer, or the like. My design uses one bolt installed vertically to join the board sections. This makes it very easy assembling and disassembling the hull. The internal joining parts are glued to the stringer of a standard foam board and actually strengthen the board. The parts can be retrofitted to an existing board or built into a new board.

The joining bolt goes through metal parts attached to the stringer of the board. The bottom metal piece is threaded for tightening the bolt. Surfboards are normally made with a center stringer, which supplies strength to the board. The stringer is disposed edgewise along the midline of the hull and extends from the top to the bottom surface. The joining metal parts are wrapped with a composite material to make two stringer attachment assemblies. These assemblies are made flat one side and are glued to the stringer of the surfboard.

My design is easy to install, adds little weight, increases the strength of the board, and is low cost. Assembly and disassembly is done with a single bolt and takes only a few seconds.

DRAWINGS—FIGURES

In the drawings, where like reference numbers indicate like parts,

DRAWINGS—REFERENCE NUMBERS

Figure 1:
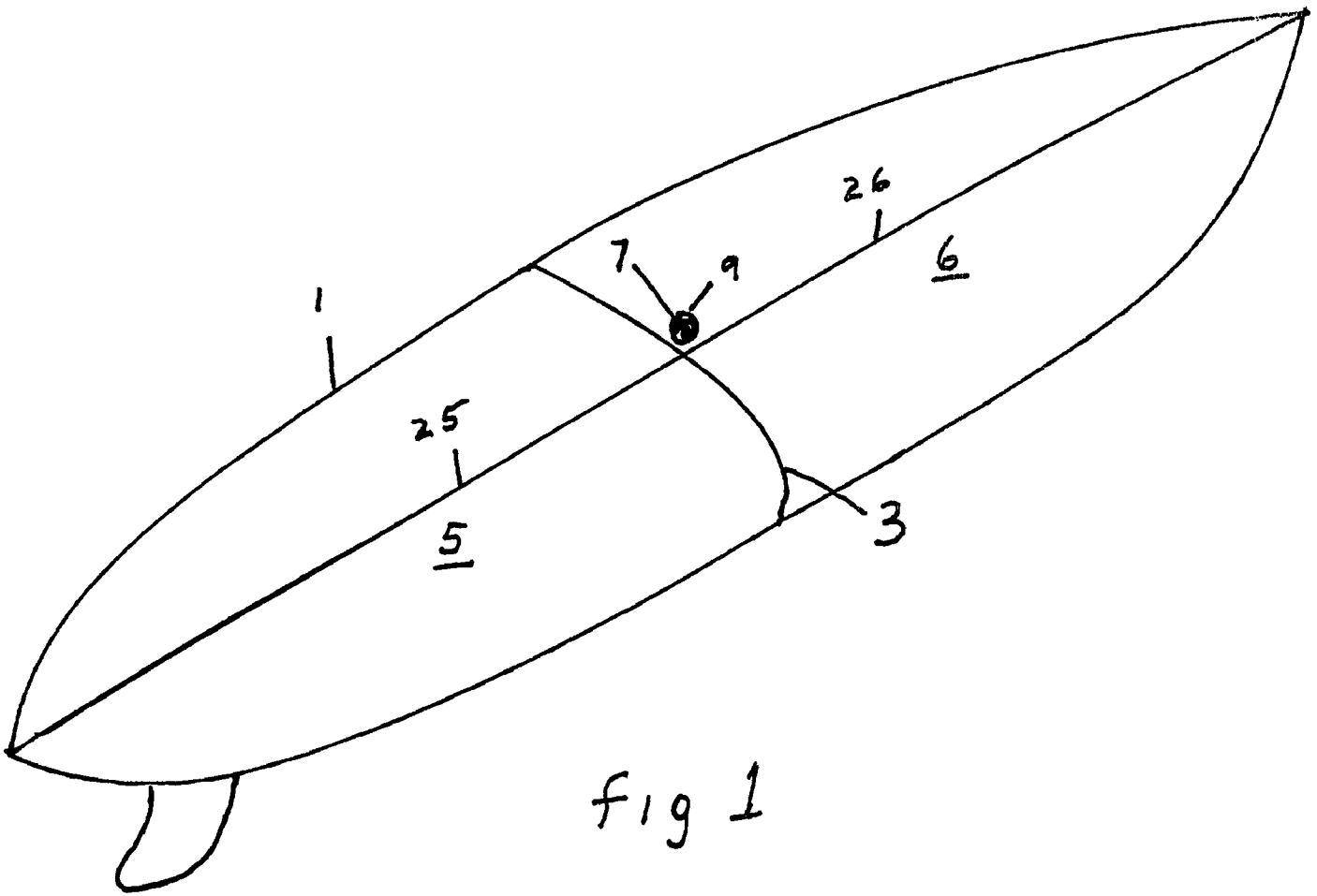
FIG. 1 is a perspective view of the fully assembled sectionalized surfboard in accordance with the present invention.

1 Surfboard hull
3 line showing where hull divides
5 back section
6 front section
7 removable joining bolt

9 hole for head of bolt
10 top metal plate
11 bottom metal plate
12 top slot in board for top metal plate
13 bottom slot in board for bottom metal plate
20 metal tube
21 fixed bolt
22 metal plate stringer attachment assembly
23 tube stringer attachment assembly
25 rear section stringer
24 front section stringer
28 tube backing piece
29 tube composite assembly
30 hole for joining bolt in top plate
31 hole for joining bolt in bottom plate
36 cavity
60 front piece for short squared C-shaped bracket
61 short squared C-shaped bracket
62 back piece for short squared C-shaped bracket
70 front piece for long squared C-shaped bracket
71 long squared C-shaped bracket
72 back piece for long squared C-shaped bracket
81 top hole on short squared C-shaped bracket
82 bottom hole on short squared C-shaped bracket
83 top hole on long squared C-shaped bracket
84 bottom hole on long squared C-shaped bracket

DETAILED DESCRIPTION OF THE PREFERRED EMBODIMENTS

Preferred embodiments of the present invention will now be described with reference to the drawings. The example of a surfboard divided into two sections will be used to illustrate these embodiments. The surfboard described is 9 ft long, 3 inches thick, and divided in the middle. However, it is not intended that the invention be limited to surfboards with only two sections or just to surfboards. Similar board like hulls such as paddleboards and sailboards could also be adapted to include the preferred embodiments. A surfboard with more than two sections can be carried in a suitcase for traveling.

FIG. 1 shows the assembled surfboard 1 in accordance with the present invention includes a front section 6, a back section 5, and a joining bolt 7 (The head of bolt 7 is recessed into hole 9 when surfboard 1 is assembled so only the top of bolt 7 is visible). Joining bolt 7 is a stainless steel socket head cap screw 5/16 inch in diameter and 2⅝ inch long. A dividing line 3 shows where the board sections separate when disassembled. A stringer installed the length of the board is cut when the board is sectionalized to form back stringer 25 and a front stringer 26. All foam and fiberglass surfboards are made with a wood stringer, which runs edgewise along the midline for the length of a surfboard.

Figure 2:
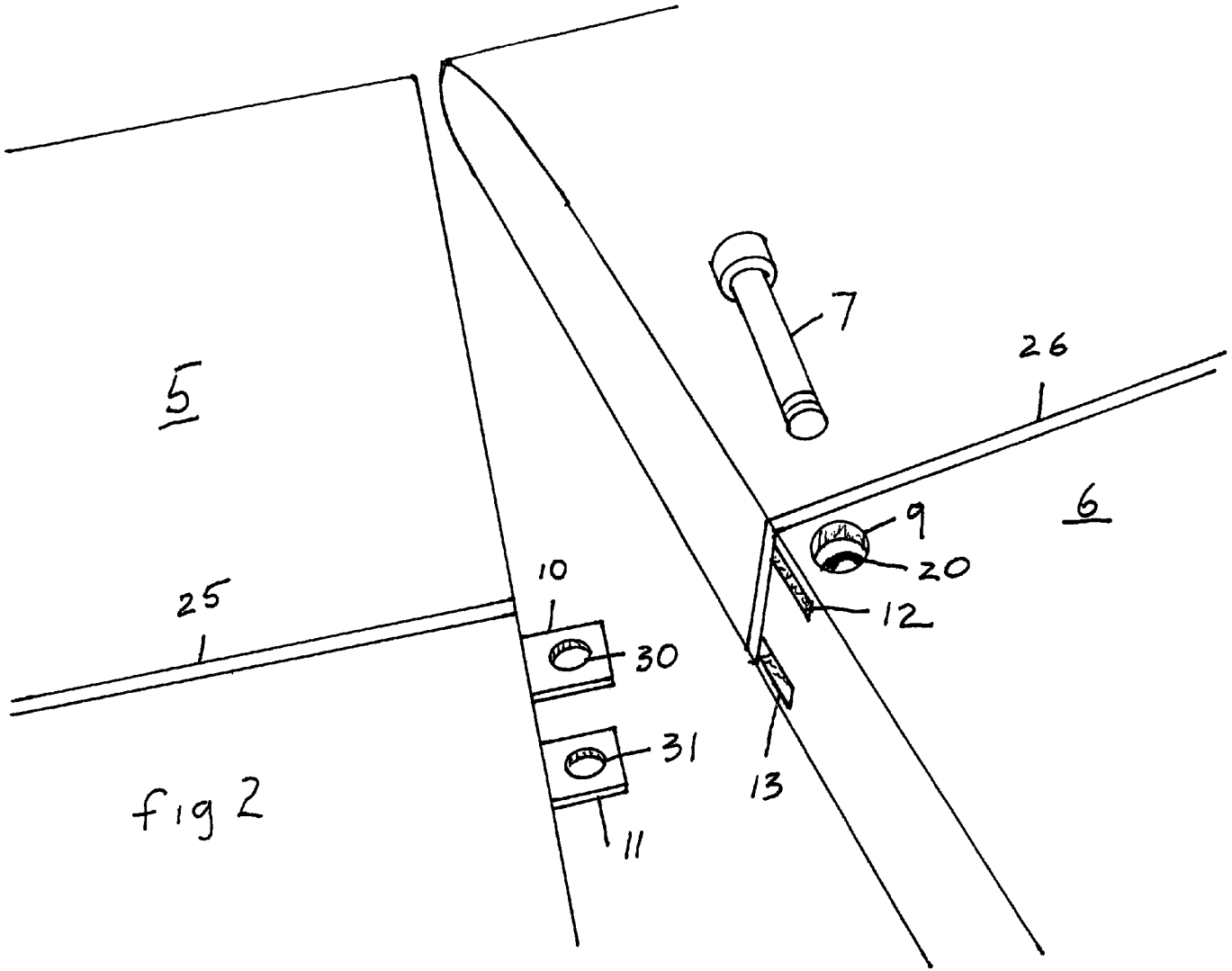
FIG. 2 is a perspective view of the center of the surfboard in FIG. 1 when disassembled showing one embodiment of the joining apparatus.

FIG. 2 shows one embodiment of surfboard 1 when sections 5 and 6 are disassembled. Top metal plate 10 and bottom metal plate 11 extend from section 5 and mate into slots 12 and 13 in section 6 when sections 5 and 6 are joined. Plate 10 is made of ⅛ inch thick stainless steel and has a 5/16 inch diameter hole 30 for the joining bolt 7. Plate 11 is made of 3/16 inch thick stainless steel has a threaded hole 31 for joining bolt 7. The plates 10 and 11 are securely mounted to stringer 25 in surfboard 1. Metal tube 20 is a vertically mounted stainless steel tube with an inside diameter of 5/16 inch, which is securely attached to stringer 26 in surfboard 1. When sections 5 and 6 are joined, hole 30 in plate 10 and hole 31 in plate 11 are in vertical alignment with center of metal tube 8. Bolt 7 can be inserted the recessed hole 8, through hole 30, through tube 8, and threaded into hole 31. Bolt 7 is then tightened into threaded hole 31 to join sections 5 and 6.

Figure 3:
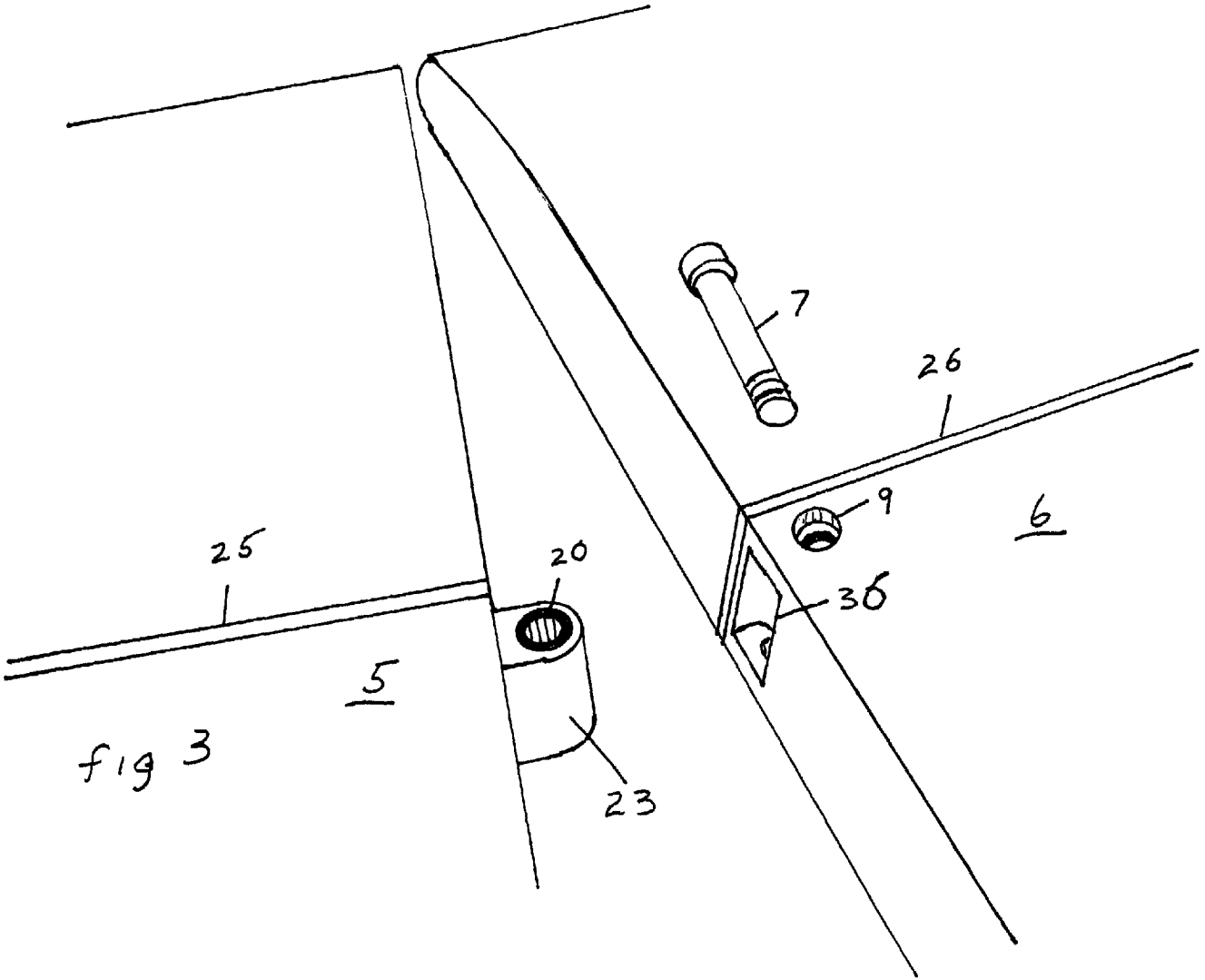
FIG. 3 is a perspective view of the center of the surfboard in FIG. 1 when disassembled showing an alternate arrangement of the embodiment of the joining apparatus.

FIG. 3 shows another embodiment of surfboard 1. The same internal parts are used as in FIG. 2 but the surfboard is separated at a different location. In this embodiment tube 20 and its stringer attachment assembly 23 partially extend from section 5. When sections 5 and 6 are assembled, tube 20 and stringer attachment reinforcement 23 fit into a cavity 36 in section 6. To join sections 5 and 6, bolt 7 is inserted through hole 9, a top metal plate 10 mounted inside section 6, tube 20, and is tightened into threaded hole 31 in metal plate 11 mounted inside section 6.

Figure 4:
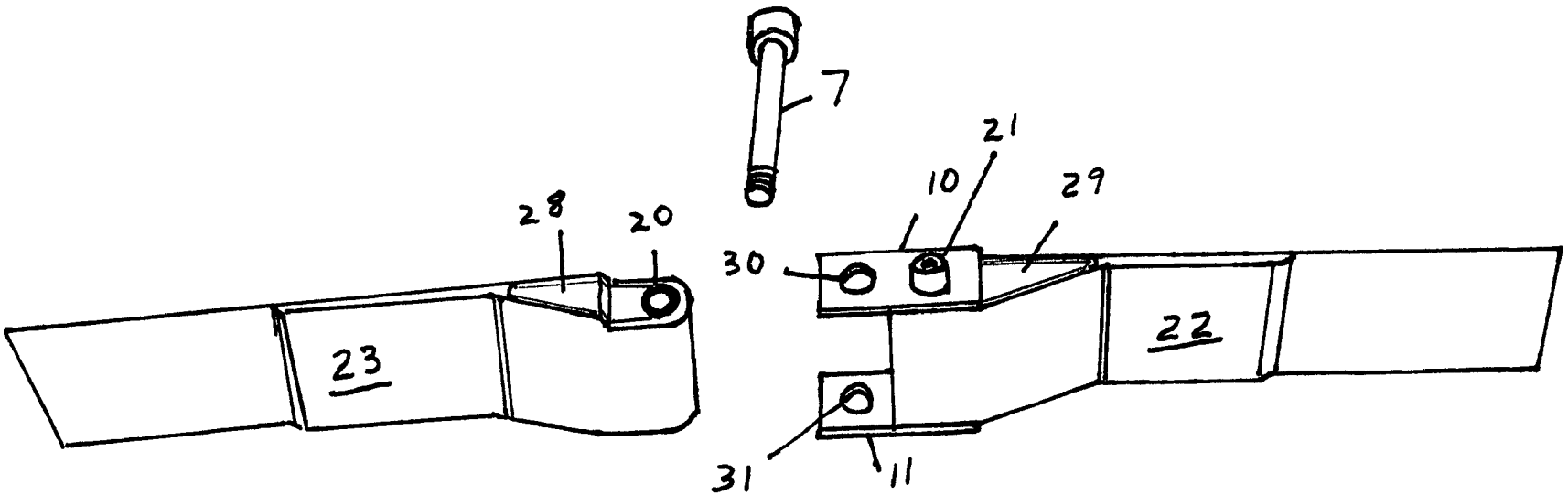
FIG. 4 is a perspective view of one embodiment of the joining apparatus.

FIG. 4 shows metal plate stringer attachment assembly 22 and tube stringer attachment assembly 23 of the preferred embodiment of the invention. Assemblies 22 and 23 are glued to stringers 25 and 26 of surfboard 1. Tube 20 is made just long enough to fit between plates 30 and 31. The inside diameter of tube 20 matches the outside diameter of bolt 7. To make assembly 23, backing piece 28 and tube 20 are glued together, wrapped with fiberglass tape and saturated with epoxy resin to make assembly 23. Assembly 23 is made flat on one side so it can be glued to stringer 26 of section 6 of surfboard 1. To make the metal plate stringer attachment assembly 22, a tube composite assembly 29, consisting of a tube, backing piece, fiberglass tape and epoxy resin is made like assembly 23. Bolt 21 is installed through a second hole in plate 10, tube composite assembly 29 and is screwed into a second threaded hole in plate 11. Assembly 22 is made flat on one side so it can be glued to stringer 25. Bolt 21, plate 10, plate 11 and tube composite assembly 22 are glued together to make metal plate stringer attachment assembly 22.

The following process is normally used to make a two-section board. Assemblies 22 and 23 are made. The board blank is shaped. A slot is cut in the foam along the stringer of the board large enough to allow for installing assemblies 22 and 23. Assemblies 22 and 23 are joined using bolt 7. This assembly is installed in the slot in the board and glued to the stringer of the board. After the glue has set, bolt 7 is removed and the board is cut into two sections. Depending on where the board is cut, embodiments shown in FIG. 2 or FIG. 3 can be produced. The two sections are then filled and the board is glassed. To assemble the board, the user simply aligns the sections and inserts and tightens bolt 7. For disassembly the user removes bolt 7 and separates the sections.

Figure 5:
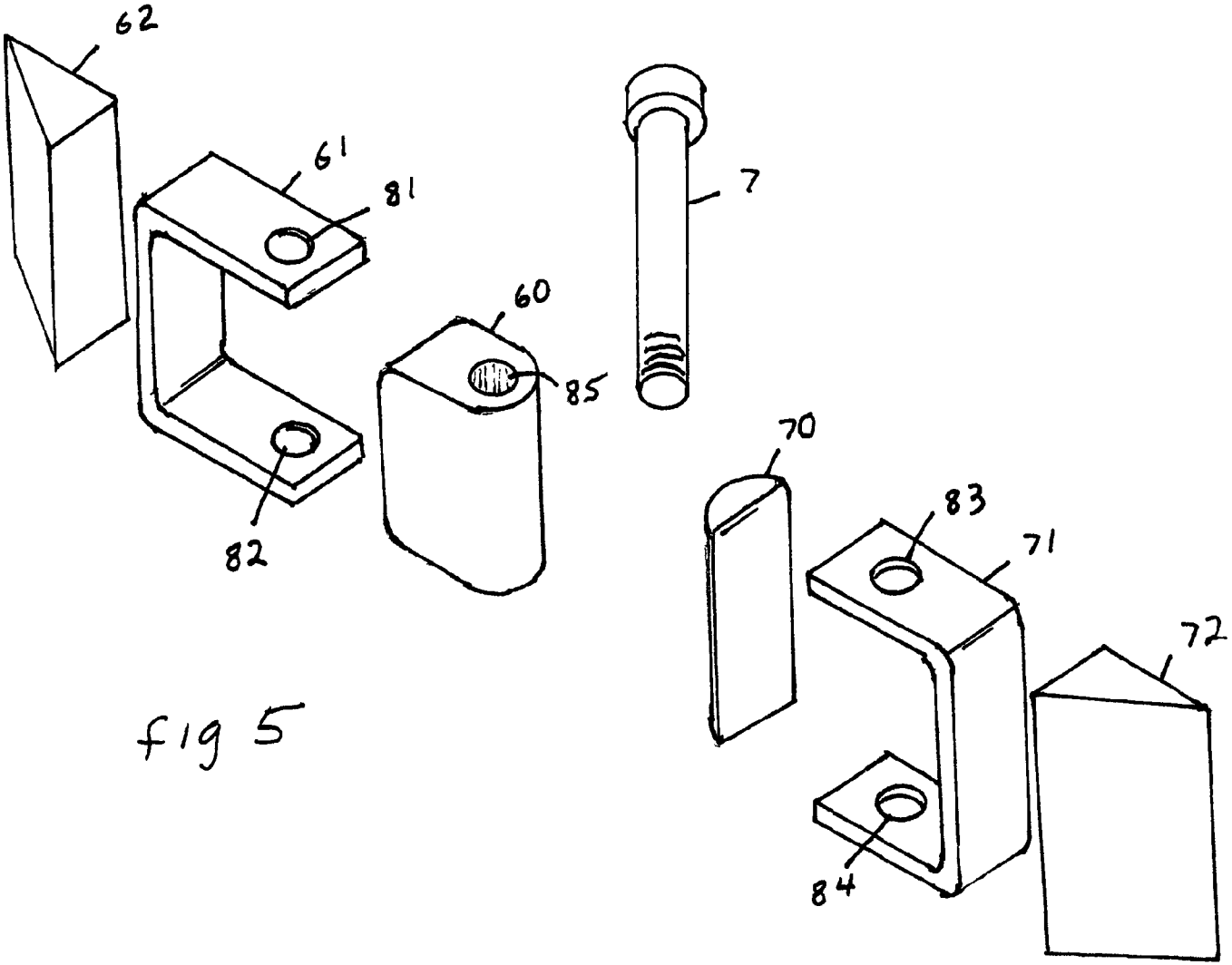
FIG. 5 is a perspective view of an alternate embodiment of the joining apparatus

FIG. 5 shows internal parts of another embodiment with different stringer attachment assemblies. In this embodiment, a metal strap is bent into the form of a squared C-shape shown as brackets 61 and 71. Long bracket 71 has a hole 83 on top and a threaded hole 84 on the bottom for assembly bolt 80. Short racket 61 has holes 81 and 82 to fit bolt 80. Bracket 61 is made to just fit inside bracket 71 to enable bolt 7 to pass through holes 83,81,85,82 and tightened into threaded hole 84. To make one stringer attachment assembly, bracket 61 is glued to front piece 60 and back piece 62, wrapped with reinforcing material and coated with thermosetting resin. To make a second stringer attachment assembly, bracket 71 is glued to front piece 70 and back piece 72, wrapped with reinforcing material and coated with thermosetting resin. They are then glued to the stringer of the surfboard. When joining sections of board 1, assembly bolt 80 is inserted through hole 83 of bracket 71, hole 81 of bracket 61, hole 85 in front piece 60, hole 82 in bracket 61 and threaded into threaded hole 84 in bracket 71.

While the present invention has been described with reference to particular embodiments, it is to be appreciated that the embodiment is illustrative and that the invention is not intended to be limited to only the disclosed embodiment. Variations within the spirit and scope of the invention will occur to those skilled in the art. For example, instead if inserting the bolt from the top, the internal assembly could be inverted and the bolt inserted from the bottom. The joining bolt could also be replaced with a pin for quicker assembly/disassembly. One of the stringer attachment assembly using squared C-shaped brackets could be used with an assembly using a metal tube. The metal plates could be mounted on both sections of the board. In another example, L-shaped metal strips would replace the metal plates, with one side of the L attached to the stringer.

I claim:

1. A sectionalized, dissassemblable surfboard, each section having at least one mating surface, at least one lengthwise centrally installed stringer, a plastic foam core, and is covered with a plastic skin; a joining means which is attached to said stringer and uses one vertically installed assembly bolt for assembly; said joining means consisting of a first board section having a metal plate assembly comprising a first rectangular metal plate with two holes, a first tube, a second rectangular metal plate with two threaded holes, and a bolt which is installed through a first hole in said first rectangular metal plate, through said first tube, and is tightened in a first threaded hole in said second rectangular metal plate so that the remaining holes are in alignment; said metal plate assembly is installed vertically in said first board section by wrapping said first tube with plastic reinforcement so said metal plate assembly can be glued firmly to said first board section stringer with a part of said rectangular metal plates with said remaining holes protruding through the plastic skin of said first board mating surface and mating to recesses in said plastic skin of said mating surface on said second board section; said second board section having a metal tube wrapped with plastic reinforcement so said metal tube can be glued firmly to said second board section stringer so that when said sections are assembled, said metal tube fits between said protruding parts of said two rectangular metal plates of said first section, said second section having recesses for said metal plates and a recess for said assembly bolt; so when said mating surfaces are assembled, said assembly bolt is inserted vertically in recess of said second board section, through said remaining hole in said first rectangular metal plate in said first board section, through said metal tube of said second section, and tightened into said remaining threaded hole of said second rectangular metal plate in said first section, so that said board sections are joined.

2. A sectionalized, dissassemblable surfboard, each section having at least one mating surface, at least one lengthwise centrally installed stringer, a plastic foam core, and is covered with a plastic skin; a joining means which is attached to said stringer and uses one vertically installed assembly bolt for assembly; said joining means consisting of a first board section having a first metal tube wrapped with plastic reinforcement which allows it to be glued vertically to said stringer with said metal tube protruding from the maling face of the first section; said second board section mating surface having a recess for said protruding vertically mounted metal tube of said first section, a metal plate assembly comprising a first rectangular metal plate with two holes, a second tube, a second rectangular metal plate with two threaded holes, and a bolt which is installed through a first hole of said first rectangular metal plate, through said second tube, and is tightened into a first threaded hole of said second rectangular metal plate so that the remaining holes are in alignment; said metal plate assembly is installed vertically in said first board section by wrapping said second tube of said metal plate assembly with plastic reinforcement so said metal plate assembly can be glued to said stringer in said second board section, said assembly mounted so said metal plates are flush with said board skin, said second board section has a recess between said metal plates for said mounted metal tube of said first board section and a recess for said assembly bolt; so that when said mating surfaces are assembled said assembly bolt is inserted through said recess in said second section, through said remaining hole in said first rectangular metal plate, through said first metal tube mounted to said first board section and tightened into said remaining threaded hole in said second rectangular metal plate, so that said board sections are joined.

* * * * *